US009320947B2

(12) United States Patent
Yamamoto

(10) Patent No.: US 9,320,947 B2
(45) Date of Patent: Apr. 26, 2016

(54) GOLF CLUB

(75) Inventor: Akio Yamamoto, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 929 days.

(21) Appl. No.: 13/239,060

(22) Filed: Sep. 21, 2011

(65) Prior Publication Data

US 2012/0071261 A1 Mar. 22, 2012

(30) Foreign Application Priority Data

Sep. 22, 2010 (JP) ..... 2010-211799

(51) Int. Cl.
*A63B 53/02* (2015.01)

(52) U.S. Cl.
CPC ..... *A63B 53/02* (2013.01); *A63B 2053/027* (2013.01)

(58) Field of Classification Search
CPC ..... A63B 53/06; A63B 59/0051; A63B 2053/021; A63B 2053/022; A63B 2053/023; A63B 2053/025; A63B 2053/026; A63B 2053/027; A63B 2053/028; A63B 53/02
USPC ..... 473/305–315, 244–248
See application file for complete search history.

(56) References Cited

U.S. PATENT DOCUMENTS

| | | | | |
|---|---|---|---|---|
| 3,663,144 | A * | 5/1972 | Pendleton et al. | 425/309 |
| 4,194,739 | A * | 3/1980 | Thompson | 473/241 |
| 5,951,411 | A * | 9/1999 | Wood et al. | 473/307 |
| 7,083,529 | B2 * | 8/2006 | Cackett et al. | 473/309 |
| 7,351,159 | B2 * | 4/2008 | Lai | 473/305 |
| 7,530,900 | B2 * | 5/2009 | Holt et al. | 473/307 |
| 7,611,422 | B2 * | 11/2009 | Hocknell et al. | 473/307 |
| 7,878,921 | B2 * | 2/2011 | Bennett et al. | 473/307 |
| 7,887,431 | B2 * | 2/2011 | Beach et al. | 473/307 |
| 7,931,542 | B2 * | 4/2011 | Kusumoto | 473/288 |
| 7,955,184 | B2 * | 6/2011 | Stites et al. | 473/288 |
| 7,963,856 | B2 * | 6/2011 | Yamamoto | 473/288 |
| 7,997,997 | B2 * | 8/2011 | Bennett et al. | 473/288 |
| 8,057,320 | B2 * | 11/2011 | Bennett et al. | 473/246 |
| 8,096,895 | B2 * | 1/2012 | Hocknell et al. | 473/307 |
| 8,133,130 | B2 * | 3/2012 | Morris et al. | 473/288 |
| 8,142,306 | B2 * | 3/2012 | De La Cruz et al. | 473/288 |
| 8,246,484 | B2 * | 8/2012 | Sato et al. | 473/307 |
| 8,535,173 | B2 * | 9/2013 | Golden et al. | 473/307 |
| 8,545,344 | B2 * | 10/2013 | De La Cruz et al. | 473/288 |
| 8,616,996 | B2 * | 12/2013 | Murphy | 473/309 |

(Continued)

FOREIGN PATENT DOCUMENTS

| | | | |
|---|---|---|---|
| JP | 61-23933 | Y2 | 7/1986 |
| JP | 5-874 | U | 1/1993 |
| JP | 3072600 | U | 10/2000 |
| JP | 3143145 | U | 7/2008 |
| JP | 2008-259862 | A | 10/2008 |
| JP | 2009-291602 | A | 12/2009 |
| JP | 2010-53991 | A | 3/2010 |

*Primary Examiner* — Stephen Blau

(74) *Attorney, Agent, or Firm* — Birch, Stewart, Kolasch & Birch, LLP

(57) ABSTRACT

A golf club 2 includes a head 4, a shaft 6, a sleeve 8, and a screw 10. The sleeve 8 is fixed to a tip part of the shaft 6. The head 4 has a head body 18 and an engaging member 20. The engaging member 20 is fixed to the head body 18. Rotation of the sleeve 8 to the head 4 is regulated based on engagement between the sleeve 8 and the engaging member 20. Withdrawal of the sleeve 8 from the head 4 is regulated based on connection between the sleeve 8 and the screw 10. The head body 18 has a screw part. The engaging member 20 has a screw part. The screw part of the head body 18 is connected to the screw part of the engaging member 20.

6 Claims, 15 Drawing Sheets

(56) References Cited

U.S. PATENT DOCUMENTS

| | | | | |
|---|---|---|---|---|
| 8,628,430 | B2 * | 1/2014 | Sato et al. | 473/307 |
| 8,777,771 | B2 * | 7/2014 | Bennett et al. | 473/307 |
| 2008/0254909 | A1 * | 10/2008 | Callinan et al. | 473/307 |
| 2009/0197696 | A1 | 8/2009 | Tsai et al. | |
| 2009/0247316 | A1 * | 10/2009 | De La Cruz et al. | 473/306 |
| 2009/0286611 | A1 | 11/2009 | Beach et al. | |
| 2009/0286618 | A1 | 11/2009 | Beach et al. | |
| 2010/0120551 | A1 * | 5/2010 | Hocknell et al. | 473/288 |
| 2010/0261543 | A1 * | 10/2010 | Breier et al. | 473/307 |
| 2013/0344981 | A1 * | 12/2013 | Knutson et al. | 473/307 |

* cited by examiner

GOLF CLUB

The present application claims priority on Patent Application No. 2010-211799 filed in JAPAN on Sep. 22, 2010, the entire contents of which are hereby incorporated by reference.

BACKGROUND OF THE INVENTION

1. Field of the Invention

The present invention relates to a golf club. In particular, the present invention relates to a golf club having a head and a shaft detachably mounted to each other.

2. Description of the Related Art

A golf club having a head and a shaft detachably mounted to each other has been proposed. It is useful to detachably mount the shaft and the head body to each other for several reasons. If golfers themselves detachably mount the shaft and the head body to each other, the golfers can change the head and the shaft easily. For example, golfers who cannot satisfy the performance of the purchased golf club easily change the head and the shaft by themselves. The golfers themselves can easily assemble an original golf club in which a favorite head and a favorite shaft are combined. The golfers can purchase the favorite head and the favorite shaft, and can assemble the head and the shaft by themselves. Golf club stores can select a combination of a head and a shaft properly corresponding to the golfer, and sell the combination. The head and the shaft detachably mounted facilitate the custom-made golf club.

U.S. Patent Application Nos. 2009/0286618 and 2009/0286611 disclose a golf club having a head and a shaft detachably mounted to each other. These U.S. patent applications disclose a structure in which an axis of a shaft hole of a sleeve is inclined to a hosel axis. The structure can adjust a loft angle or the like.

A structure using a hosel insert 200 is disclosed in FIGS. 2 and 60 of U.S. Patent Application No. 2009/0286618. The hosel insert 200 is fixed to an inside of a hosel hole. The hosel insert 200 can prevent rotation of a sleeve.

SUMMARY OF THE INVENTION

When the shaft (sleeve) is insufficiently fixed, a function as the golf club cannot be fulfilled. Certain fixation between the shaft and the head leads to the reliability of the club. Very slight join failure loses a commodity value. Accuracy of the join and endurance of the join are important.

It is an object of the present invention to provide a golf club having a head and a shaft detachably mounted to each other, and having high reliability.

A golf club of the present invention includes a head, a shaft, a sleeve, and a screw. The sleeve is fixed to a tip part of the shaft. The head has a head body and an engaging member. The engaging member is fixed to the head body. Rotation of the sleeve to the head is regulated based on engagement between the sleeve and the engaging member. Withdrawal of the sleeve from the head is regulated based on connection between the sleeve and the screw. In the golf club, a connected state where the screw is connected to the sleeve and a disconnected state where the screw is removed from the sleeve can be mutually shifted. The head body has a screw part for connecting the engaging member to the head body. The engaging member has a screw part. The screw part of the head body is connected to the screw part of the engaging member.

Preferably, the engaging member receives an axial force of the screw in the connected state.

Preferably, the golf club further includes an intermediate member. Preferably, the intermediate member has a screw part which can be connected to the screw. Preferably, the screw is allowed to be screw-connected to the intermediate member in the disconnected state.

Preferably, the screw cannot be screw-connected to the intermediate member in the connected state. Preferably, the screw is screw-connected to the intermediate member in a process in which the connected state is shifted to the disconnected state.

Preferably, the intermediate member is in a non-fixed state. Preferably, release of the intermediate member caused by gravity is prevented.

Preferably, a space exists, the space can allow the intermediate member to move in an axial direction.

Preferably, the intermediate member receives an axial force from the screw in the connected state.

A golf club having a mounting/detaching mechanism having excellent reliability can be obtained.

BRIEF DESCRIPTION OF THE DRAWINGS

FIG. 3 is a cross sectional view of a vicinity of a hosel, and FIG. 3 shows a connected state;

FIG. 4 shows a disconnected state;

DESCRIPTION OF THE PREFERRED EMBODIMENTS

The present invention will be described below in detail based on preferred embodiments with reference to the drawings.

Unless otherwise described, "an axial direction" in the present application means an axial direction of a hosel hole, and "A radial direction" means a radial direction of the hosel hole.

Figure 1:
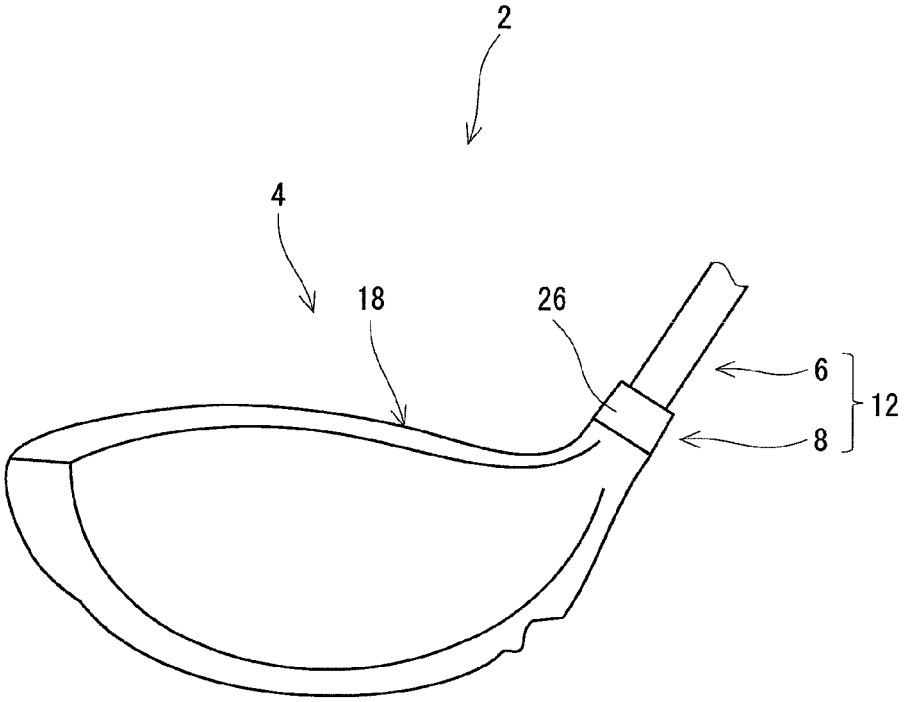
FIG. 1 is a view showing a golf club according to one embodiment of the present invention.
Figure 2:
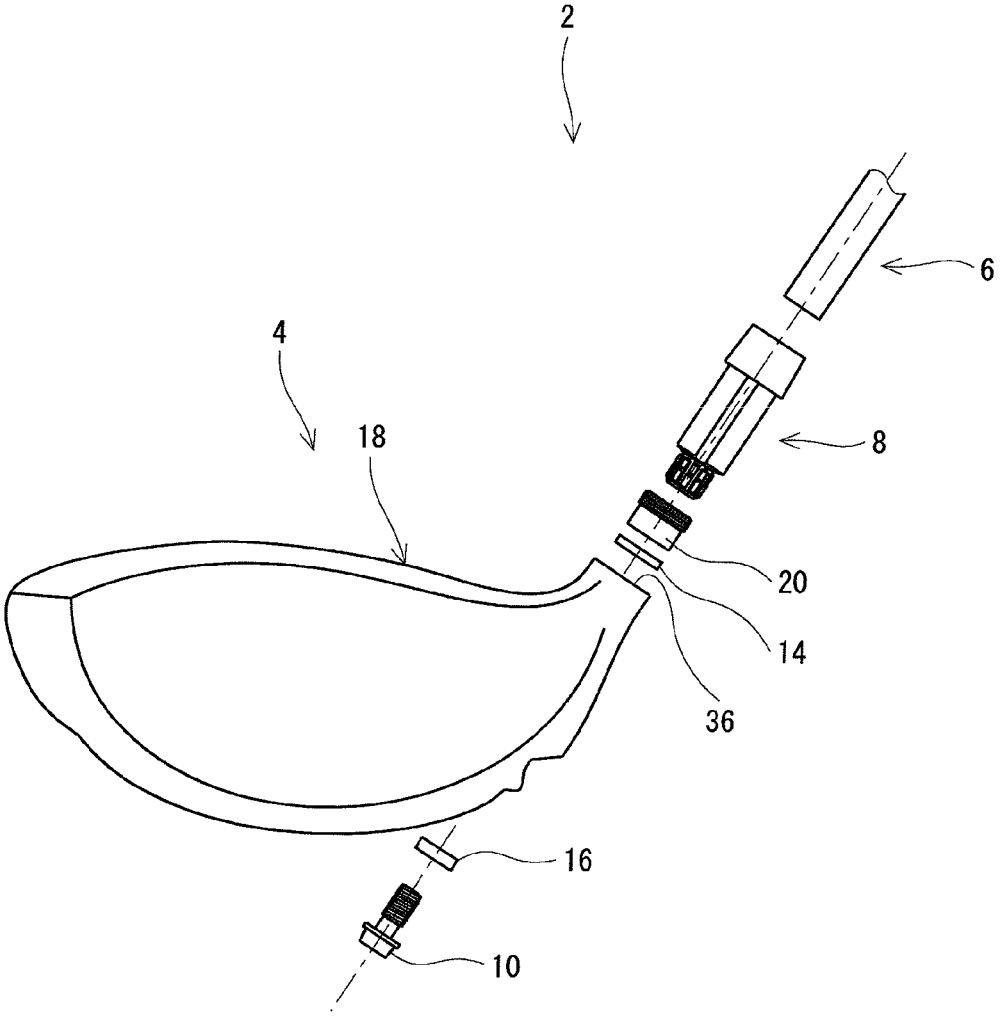
FIG. 2 is an exploded view of FIG. 1.
Figure 3:
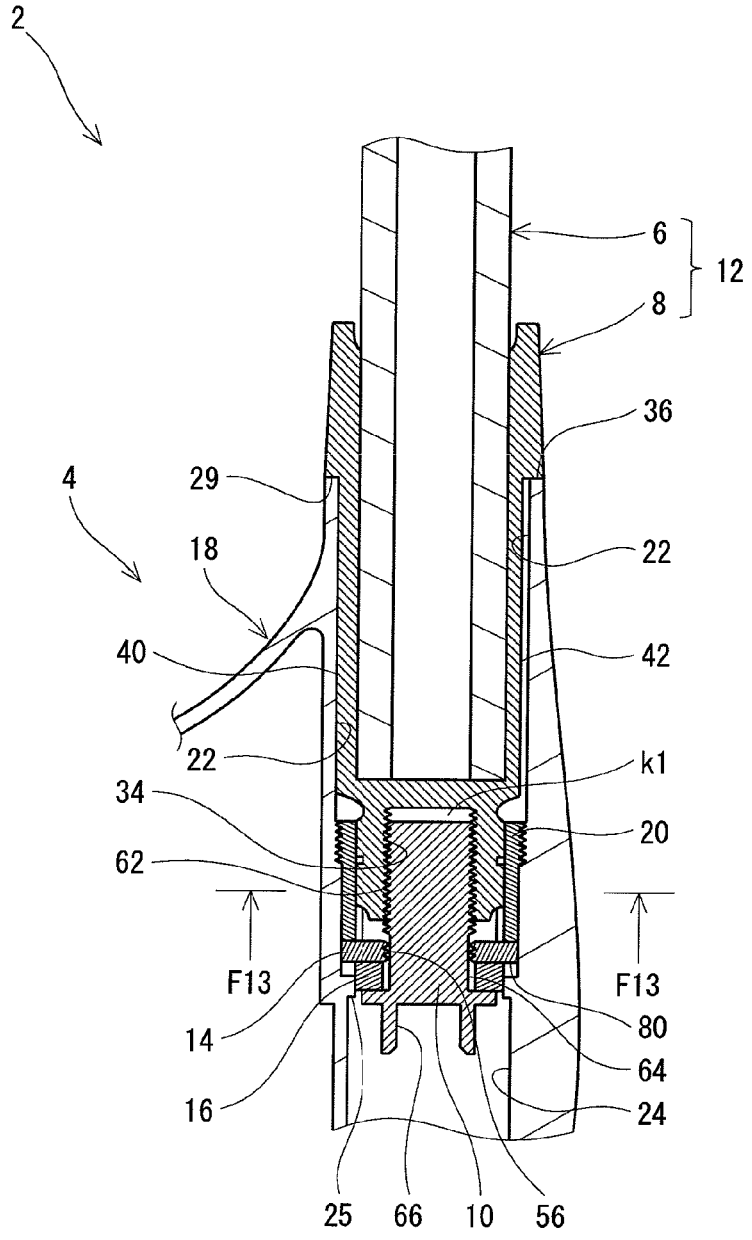
FIG. 3 is a cross sectional view of FIG. 1.

FIG. 1 shows a golf club 2 according to one embodiment of the present invention. FIG. 1 shows only a vicinity of a head of the golf club 2. FIG. 2 is an exploded view of the golf club 2. FIG. 3 is a cross sectional view of the golf club 2. FIG. 3 is a cross sectional view taken along a center axis line of a sleeve 8.

The golf club 2 has a head 4, a shaft 6, a sleeve 8, and a screw 10. The sleeve 8 is fixed to a tip of the shaft 6. A grip (not shown) is mounted to a butt of the shaft 6. A shaft-sleeve assembly 12 is formed by the shaft 6 and the sleeve 8 fixed to each other.

The golf club 2 further has an intermediate member 14 and a washer 16.

The head 4 has a head body 18 and an engaging member 20. The head body 18 has a hosel hole 22 into which the sleeve 8 is inserted, and a through hole 24 into which the screw 10 is inserted. The through hole 24 penetrates a bottom part of the hosel hole 22, and reaches a sole. The head body 18 has a hollow part.

As shown in FIG. 3, the head body 18 has a flange 25. The flange 25 is located below the sleeve 8 (sole side) in a connected state. An inner diameter of the flange 25 is greater than an outer diameter d2 of the washer 16.

A type of the head 4 is not restricted. The head 4 of the embodiment is a wood type golf club. The head 4 may be a utility type head, a hybrid type head, an iron type head, and a putter head or the like. The shaft 6 is not restricted. A generalized carbon shaft, and a steel shaft or the like can be used.

Figure 4:
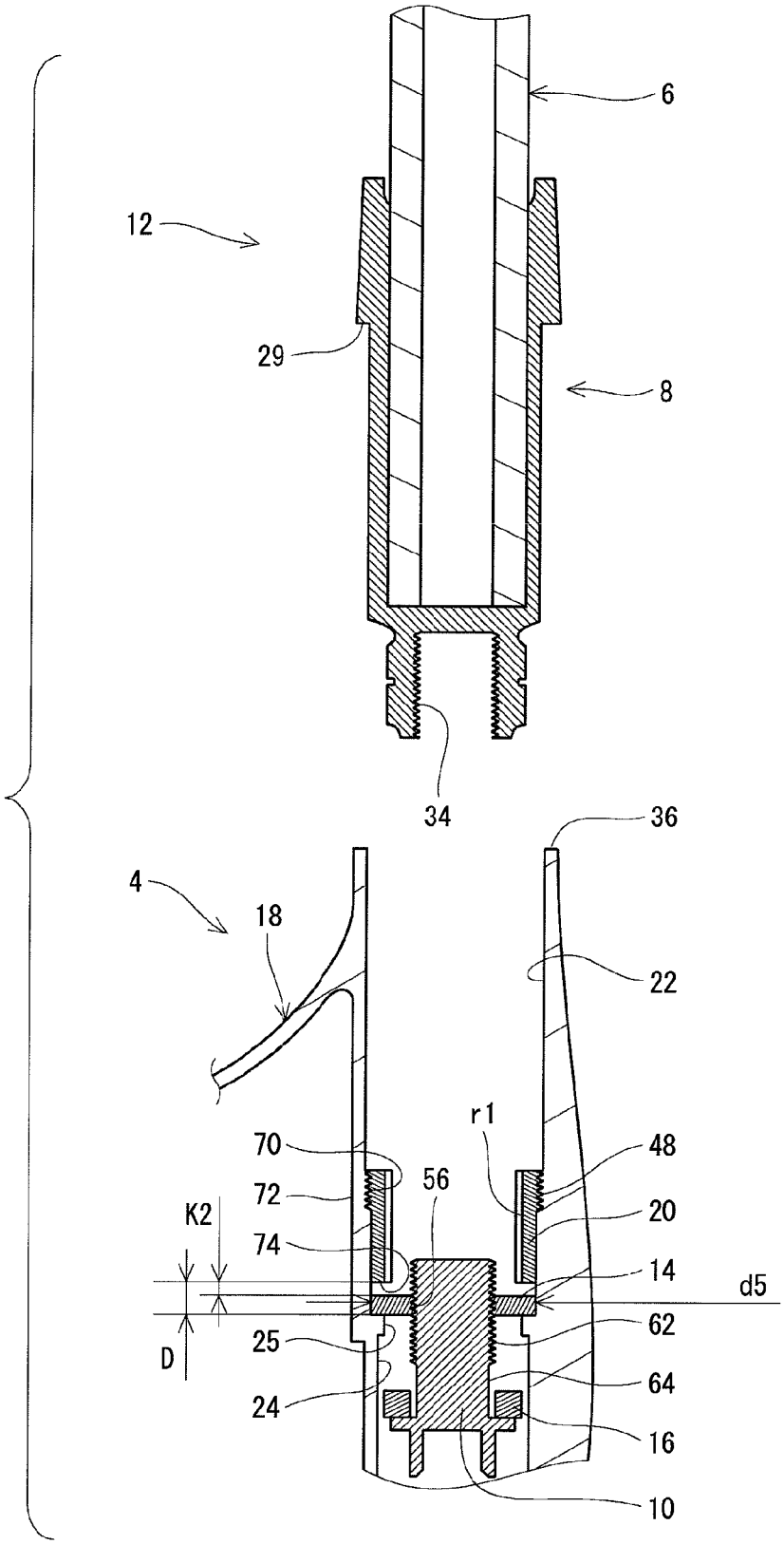
FIG. 4 is an exploded view of FIG. 3.

The shaft-sleeve assembly 12 is fixed to the head 4 by fastening the screw 10. A state where the shaft-sleeve assembly 12 is fixed is also referred to as a connected state in the present application. The shaft-sleeve assembly 12 is separated from the head 4 by loosening the screw 10. Thus, in the head 2, the head 4 and the shaft 6 are detachably mounted to each other. FIG. 4 is a cross sectional view showing a state where the shaft-sleeve assembly 12 is disconnected from the head 4. The state where the shaft-sleeve assembly 12 is separated from the head 4 is also referred to as a disconnected state in the present application.

Figure 5:
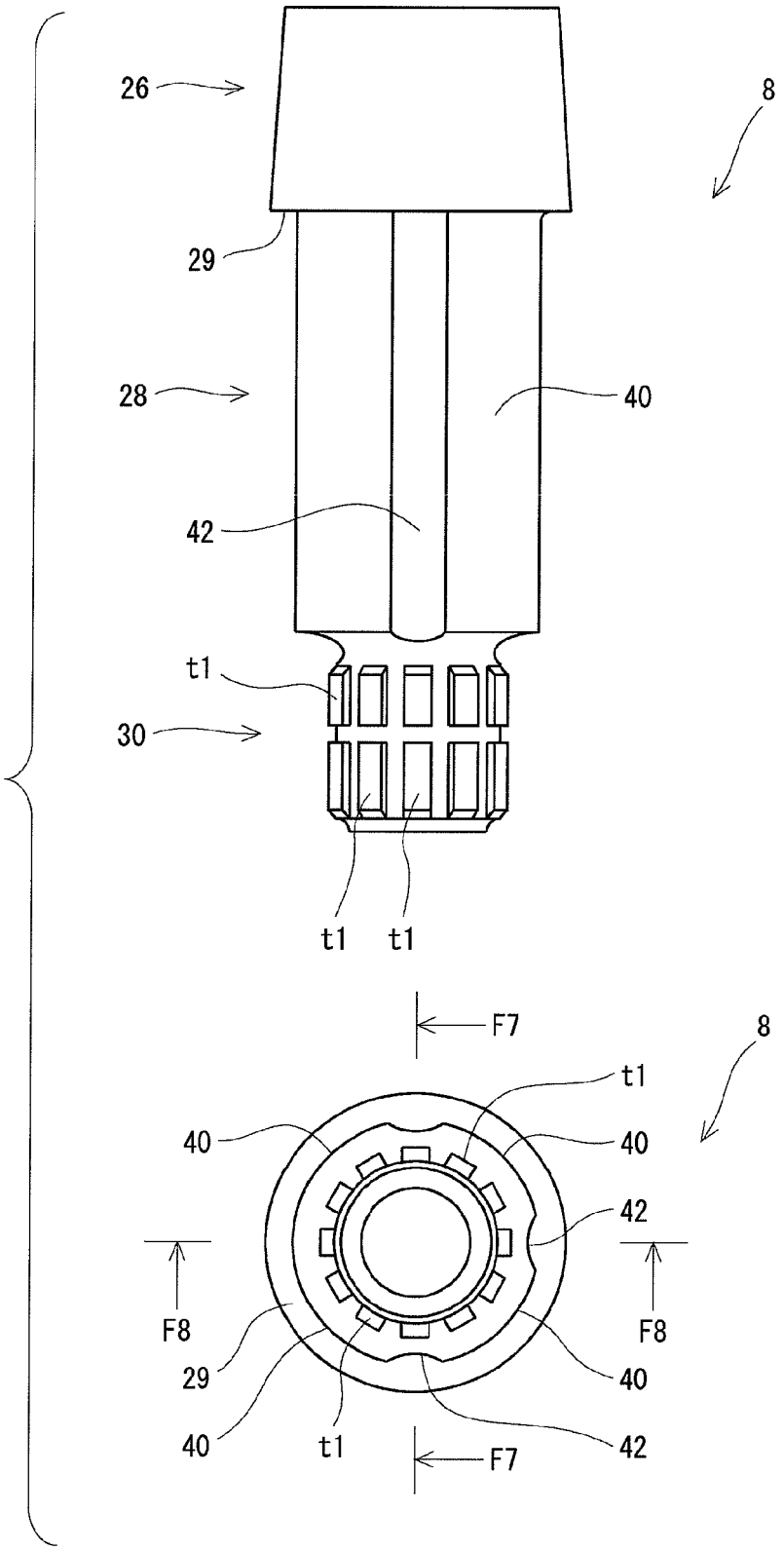
FIG. 5 shows a side view and a bottom view of a sleeve.
Figure 6:
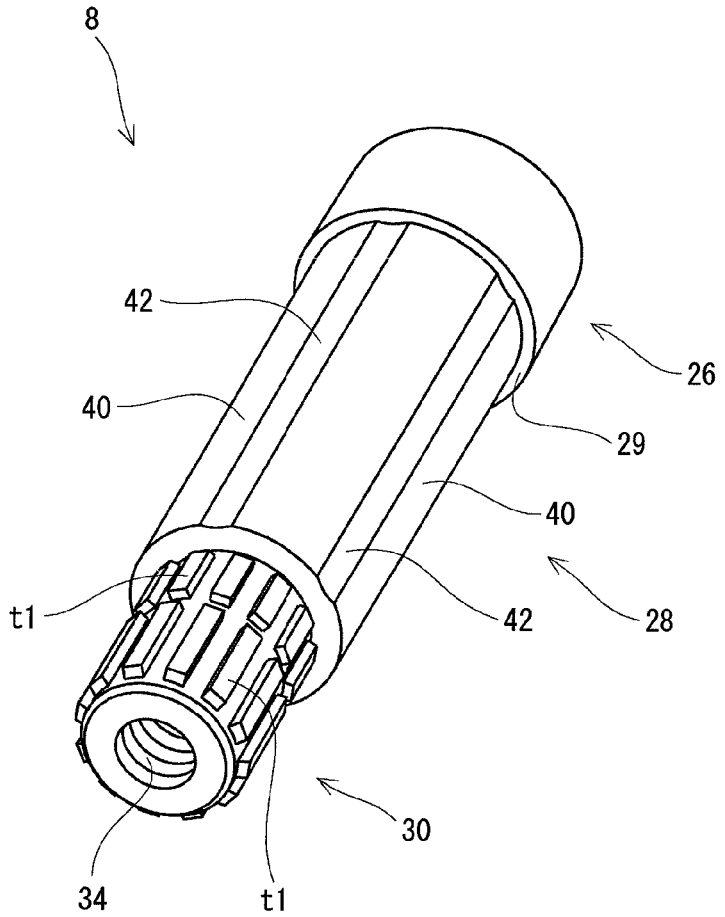
FIG. 6 is a perspective view of the sleeve of FIG. 5.
Figure 7:
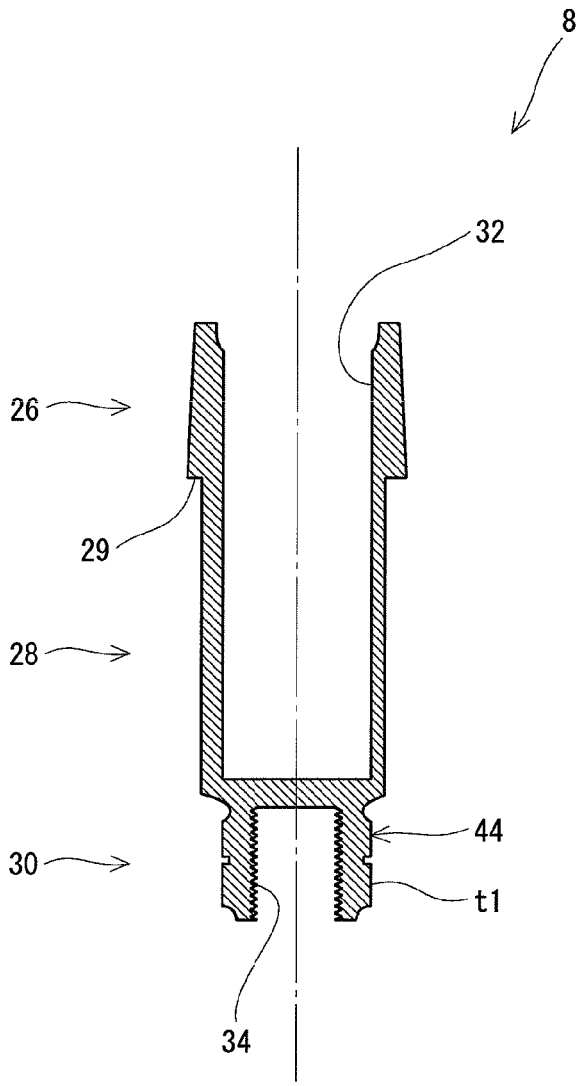
FIG. 7 is a cross sectional view taken along line F7-F7 of FIG. 5.
Figure 8:
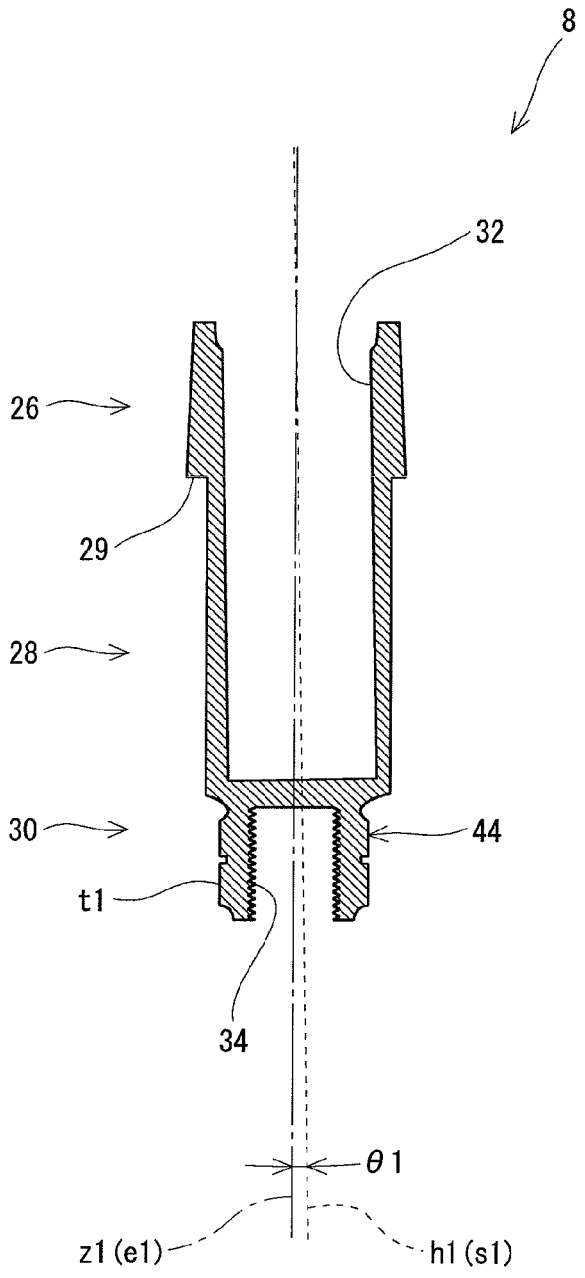
FIG. 8 is a cross sectional view taken along line F8-F8 of FIG. 5.

FIG. 5 shows a side view and a bottom view of the sleeve 8. The side view is an upper view of FIG. 5, and the bottom view is a lower view of FIG. 5. FIG. 6 is a perspective view of the sleeve 8. FIG. 7 is a cross sectional view taken along line F7-F7 of FIG. 5. FIG. 8 is a cross sectional view taken along line F8-F8 of FIG. 5.

The sleeve 8 has an upper part 26, an intermediate part 28, and a lower part 30. A bump surface 29 exists on a boundary between the upper part 26 and the intermediate part 28. The sleeve 8 has a shaft hole 32 and a screw hole 34. The shaft hole 32 is located medially in the upper part 26 and the intermediate part 28. The shaft hole 32 is opened to one side (an upper side). The screw hole 34 is opened to other side (a lower side). The screw hole 34 is located medially in the lower part 30.

The upper part 26 is exposed in the connected state. In the connected state, the bump surface 29 abuts on a hosel end face 36 of the head 4. As shown in FIG. 1, an outer diameter of a lower end of the upper part 26 is substantially equal to an outer diameter of the hosel end face 36. In the connected state, the upper part 26 exhibits an appearance like a ferrule. In the connected state, the intermediate part 28 and the lower part 30 are located medially in the hosel hole 22.

An external surface of the intermediate part 28 of the sleeve 8 has a circumferential surface 40 and a recessed surface 42. The recessed surface 42 is a groove. The recessed surface 42 extends along an axial direction of the sleeve 8. The recessed surface 42 extends over the entire longitudinal direction of the intermediate part 28.

In the connected state, the circumferential surface 40 is brought into contact with the hosel hole 22. The entire circumferential surface 40 is brought into contact with the hosel hole 22. The contact collateralizes the retention of the sleeve 8 caused by the hosel hole 22. On the other hand, in the connected state, the recessed surface 42 is not brought into contact with the hosel hole 22. The recessed surface 42 contributes to weight reduction of the sleeve 8.

An external surface of the lower part 30 of the sleeve 8 forms a rotation-preventing part 44. A section shape of the rotation-preventing part 44 is a non-circular form. The rotation-preventing part 44 has a plurality of convex parts t1. The convex parts t1 are outwardly projected in the radial direction. The convex parts t1 are disposed at equal intervals in a circumferential direction. In the embodiment, the convex parts t1 are disposed at every 30 degrees in the circumferential direction.

As shown in FIG. 8, an axis line h1 of the shaft hole 32 is inclined to an axis line z1 of the circumferential surface 40 of the sleeve 8. The inclination angle θ1 is a maximum value of an angle between the axis line h1 and the axis line z1. In the connected state, the axis line z1 is equal to an axis line e1 of the hosel hole 22. The axis line h1 of the shaft hole 32 is equal to an axis line s1 of the shaft 6.

Figure 9:
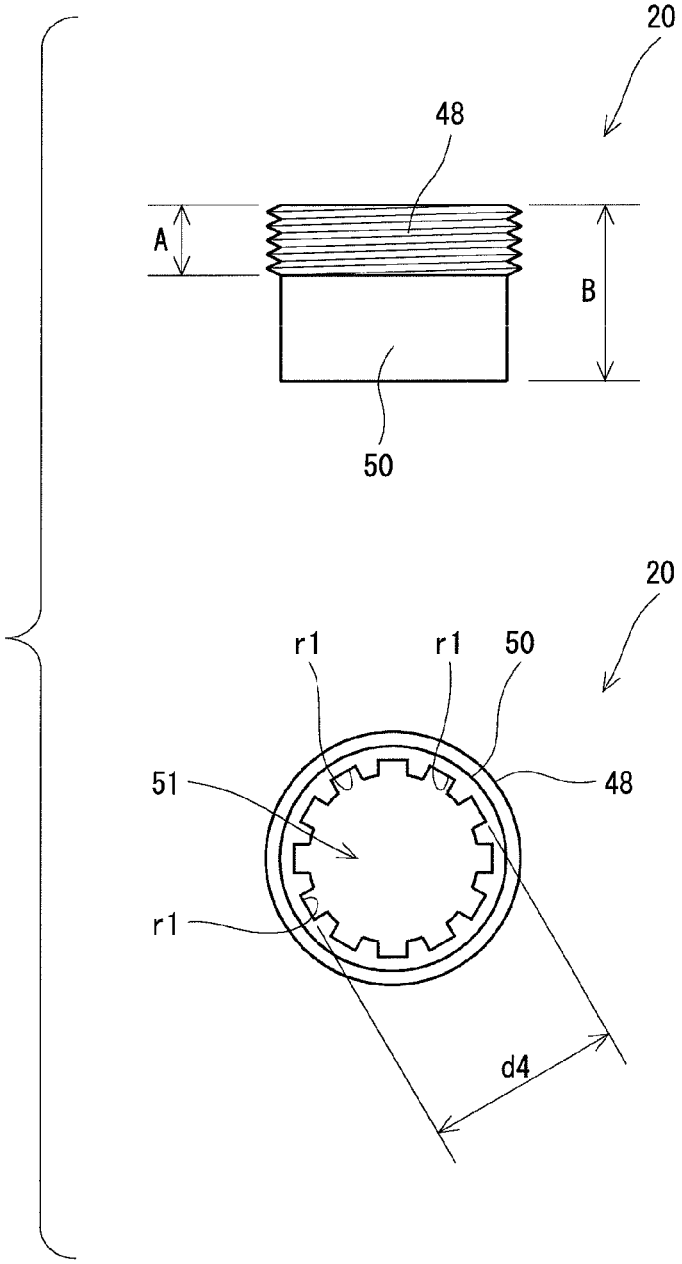
FIG. 9 shows a side view and a bottom view of an engaging member.

FIG. 9 shows a side view and a bottom view of the engaging member 20. The engaging member 20 has a tubular shape as a whole. An external surface of the engaging member 20 has a screw part 48 and a non-screw part 50. The screw part 48 is a male screw. The non-screw part 50 is a circumferential surface. The entire external surface of the engaging member 20 may be a screw part.

A section shape of an inner surface of the engaging member 20 is a non-circular form. The section shape of the inner surface of the engaging member 20 corresponds to that of an external surface of the rotation-preventing part 44 of the sleeve 8. A plurality of concave parts r1 is formed in the inner surface of the engaging member 20. A shape of the concave part r1 corresponds to that of the convex part t1 described above. The concave parts r1 are formed at equal intervals in the circumferential direction. The concave parts r1 are formed at every 30 degrees in the circumferential direction.

The inner surface of the engaging member 20 forms a rotation-preventing part 51. The rotation-preventing part 51 is engaged with the rotation-preventing part 44 of the sleeve 8, to prevent rotation of the sleeve 8.

Figure 10:
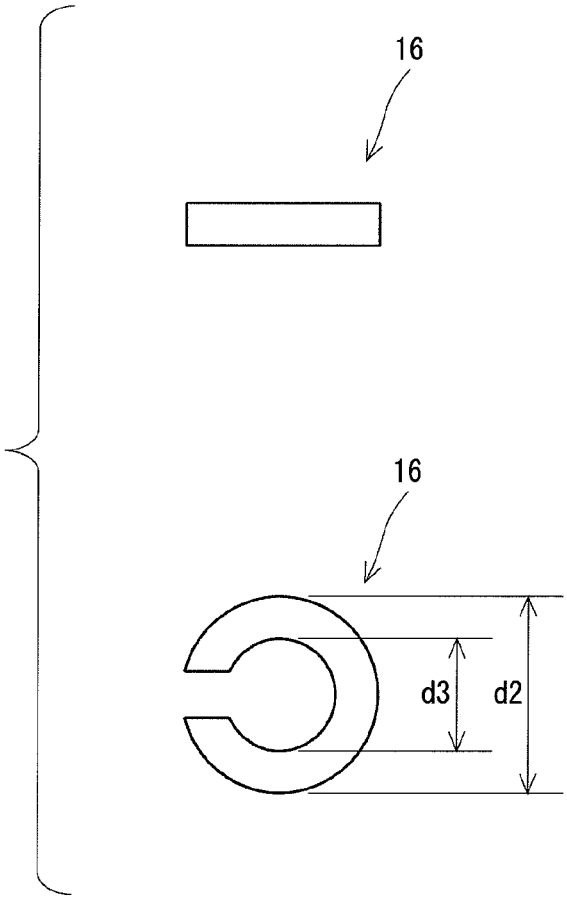
FIG. 10 shows a side view and a bottom view of a washer.

FIG. 10 shows a side view and a bottom view of the washer 16. The washer 16 is an annular member disconnected at one place in a circumferential direction.

Figure 11:
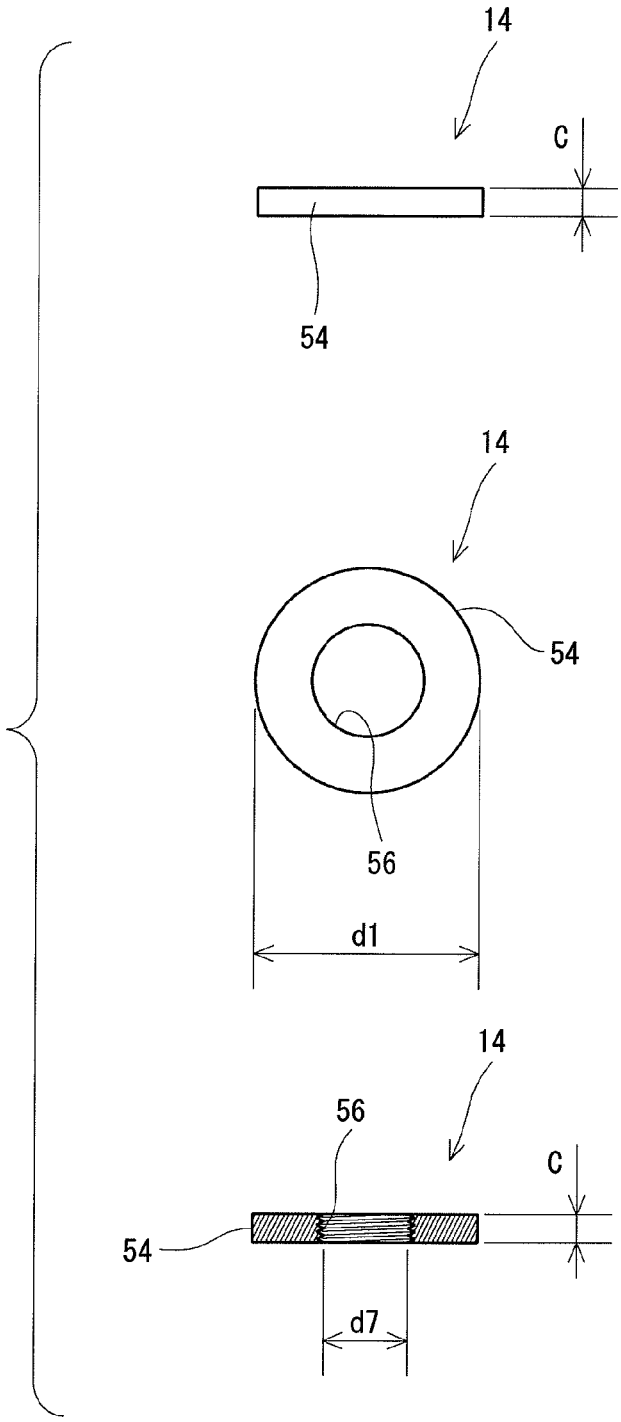
FIG. 11 shows a side view, a bottom view, and a cross sectional view of an intermediate member.

FIG. 11 shows a side view, a bottom view, and a cross sectional view of the intermediate member 14. The side view is an upper view of FIG. 11; the bottom view is a middle view of FIG. 11; and the cross sectional view is a lower view of FIG. 11. The intermediate member 14 is a circular member. An outer peripheral surface 54 of the intermediate member 14 is a circumferential surface. An inner peripheral surface 56 of the intermediate member 14 is a screw part. The inner peripheral surface 56 is a female screw.

Figure 12:
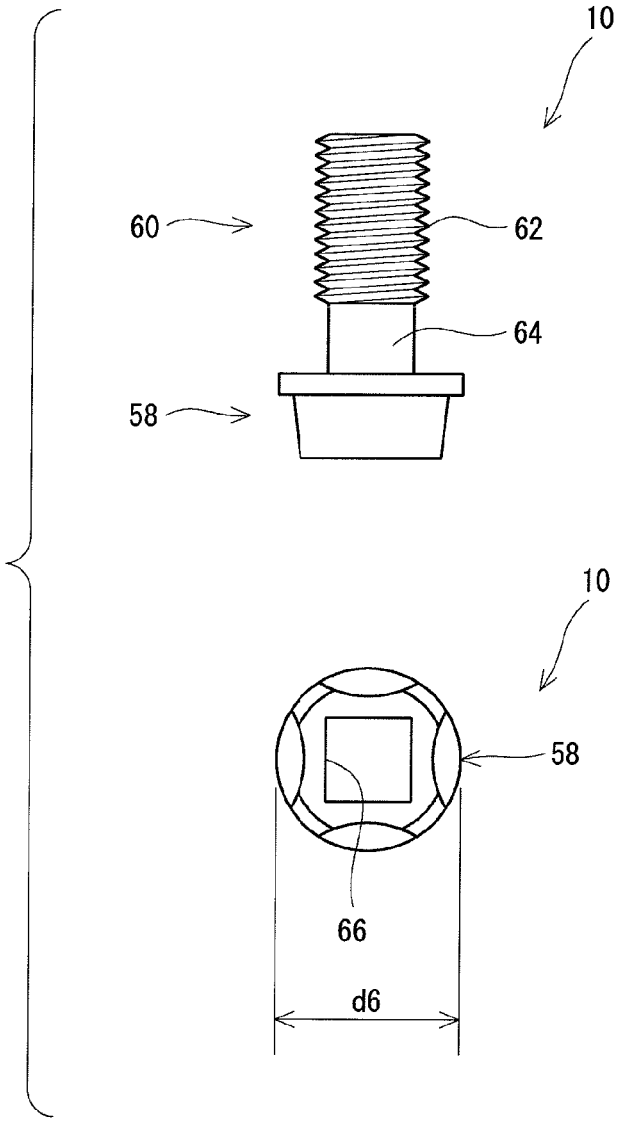
FIG. 12 shows a side view and a plan view of a screw.

FIG. 12 shows a side view and a plan view of the screw 10. The screw 10 has a head part 58 and an axis part 60. The axis part 60 has a screw part 62 and a non-screw part 64. The non-screw part 64 is located on the head part 58 side from the screw part 62.

The head part 58 has a concave part 66 for a wrench. The screw 10 can be axially rotated by using the wrench (a dedicated wrench or the like) fitted into the concave part 66. The sleeve 8 can be detachably mounted by the axial rotation.

The retention of the sleeve 8 is achieved by screw connection. As shown in FIG. 3, the screw hole 34 of the sleeve 8 is screw-connected to the screw part 62 of the screw 10. The screw connection prevents the withdrawal of the sleeve 8. An axial force caused by the screw connection is balanced with a pressure between the hosel end face 36 and the bump surface 29. In order to collateralize the axial force, a clearance K1 exists between a tip of the screw 10 and a bottom face of the screw hole 34 in the connected state (see FIG. 3).

Figure 13:
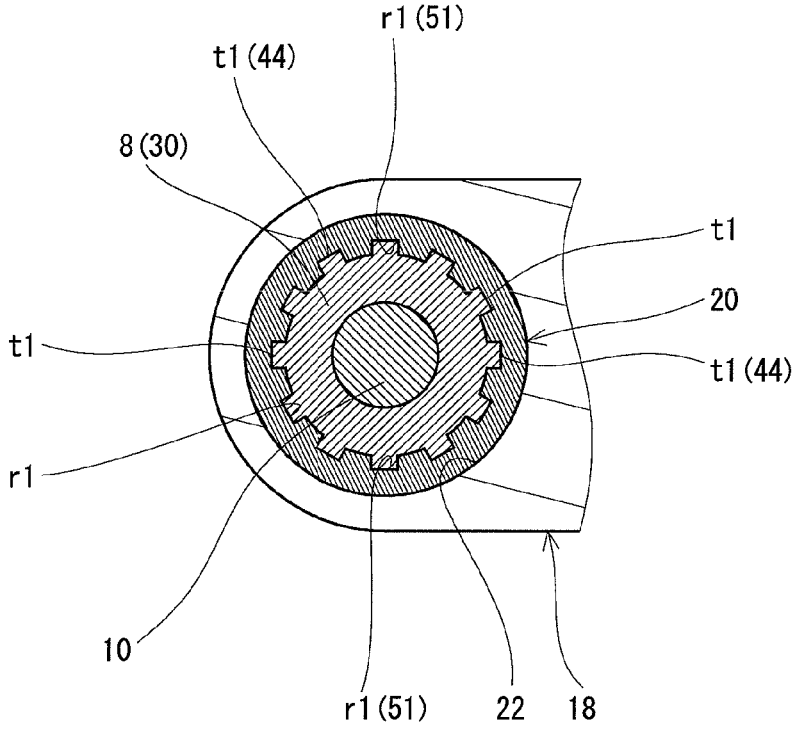
FIG. 13 is a cross sectional view taken along line F13-F13 of FIG. 3.

FIG. 13 is a cross sectional view taken along line F13-F13 of FIG. 3. As shown in FIG. 13, the rotation-preventing part 44 of the sleeve 8 is engaged with the rotation-preventing part 51 of the engaging member 20. The engagement prevents the rotation of the sleeve 8 to the engaging member 20.

The engaging member 20 is fixed to the head body 18.

The method for fixing the engaging member 20 is not restricted, and examples thereof include welding, bonding, fitting, screw connection, and a combination thereof. In the embodiment, the screw connection is employed as the method for fixing the engaging member 20. As shown in FIG. 4, a screw part 70 is formed in the hosel hole 22. The screw part 70 is a female screw. The screw part 70 is screw-connected to the screw part 48 of the engaging member 20.

Slight failure is not allowed in the engagement between the engaging member 20 and the sleeve 8. The commodity value of the club is lost by slight wobbling. High accuracy is required for positioning the engaging member 20. Positioning accuracy of the engaging member 20 is improved by forming the screw part 70 in the hosel hole 22 and screw-connecting the screw part 48 of the engaging member 20 to the screw part 70. That is, the engaging member 20 has reduced position error in an axial direction and reduced direction error of an axis line.

Preferably, the screw connection between the screw part 70 of the hosel hole 22 and the screw part 48 of the engaging member 20 is fastened by a force applied to the head from a ball at hitting the ball. The configuration provides no looseness caused by hitting the ball.

Welding is employed to fix the engaging member 20, in addition to the screw connection. That is, the screw connection and the welding are used in combination. At least a part of a boundary surface between the engaging member 20 and the head body 18 is welded, which is not shown in the cross sectional views of FIGS. 3 and 4. The welding may include a screw connection portion, or may not include the portion. The combined use of the screw connection and the welding ensures the fixation of the engaging member 20. The combined use of the screw connection and the welding prevents the looseness of the screw connection. The combined use of the screw connection and the welding improves fixing strength of the engaging member 20 to the head body 18.

When the welding is employed, a kind of the welding is not restricted. Examples of the kind of the welding include laser welding, arc welding, gas welding, and thermite welding.

In the embodiment, the engaging member 20 is welded to the head body 18 by heating from a hosel external surface 72. The method is suitable for welding the engaging member 20 located in a depth of the hosel hole 22. In the embodiment, the laser welding is employed. In the embodiment, the hosel external surface 72 is irradiated with laser, to weld the engaging member 20 to the head body 18. Since a heating range of the laser welding is local, the laser welding can suppress deformation of the engaging member 20 and the hosel hole 22. Therefore, high dimensional accuracy of the engaging member 20 and the hosel hole 22 tends to be maintained, and positional accuracy of the engaging member 20 tends to be also maintained.

Even if a heating trace is left in the hosel external surface 72 located in the head, the heating trace is invisible in the completed head. Therefore, it is unnecessary to restore the heating trace in order to improve an appearance of the head. The unnecessary restoration can improve productivity of the head.

Figure 14:
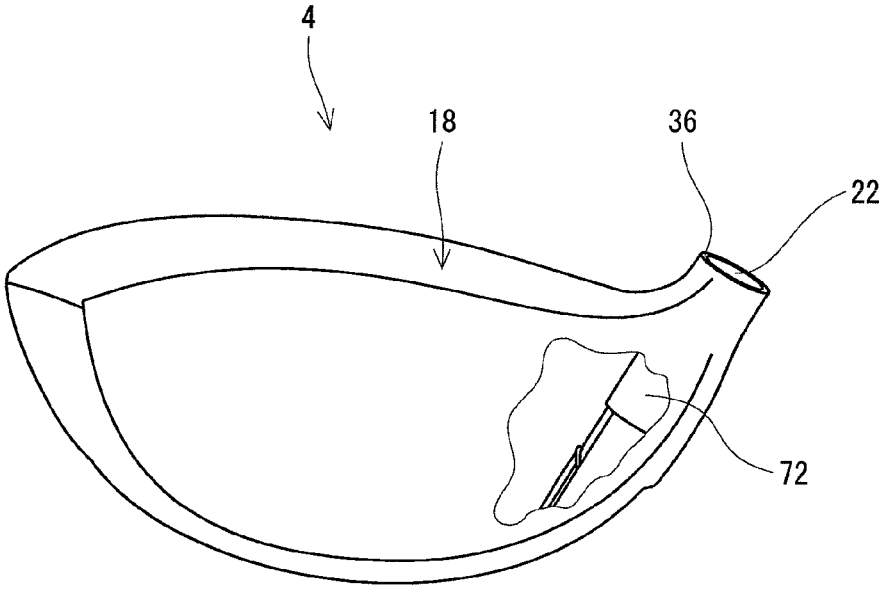
FIG. 14 is a partially cutout perspective view of a head.

FIG. 14 is a perspective view of the head 4 having a partially cutout face. As shown in FIG. 14, the hosel external surface 72 located in the head is irradiated with laser, to weld the engaging member 20 to the head body 18. Although the head body 18 includes a plurality of members, the engaging member 20 is welded to the head body 18 before all of the plurality of members is joined.

Slight failure is not allowed in the engagement between the engaging member 20 and the sleeve 8. The engaging member 20 is a separate body from the head body 18, to improve a freedom degree of a processing method of the engaging member 20. Thereby, the engaging member 20 can be processed with high dimensional accuracy. Therefore, accuracy of the engagement between the engaging member 20 and the sleeve 8 is improved.

As described above, the engaging member 20 is a separate body from the head body 18, and thereby the dimensional accuracy of the engaging member 20 is high. Therefore, a lower surface 74 (see FIG. 4) of the engaging member 20 tends to become perpendicular to the axial direction with high accuracy. The high orientation accuracy of the lower surface 74 tends to cause uniform dispersion of the axial force in the connected state in a circumferential direction of the engaging member 20. The uniform dispersion can improve the fixing strength of the engaging member 20.

In the connected state, the engaging member 20 receives the axial force from the screw 10. As shown in FIG. 3, the axial force caused by the screw 10 is transmitted to the engaging member 20 via the intermediate member 14. The engaging member 20 receives the axial force from the screw 10. The securely fixed engaging member 20 can withstand the axial force from the screw 10.

The intermediate member 14 is a separate body from the head body 18, to improve a freedom degree of a processing method of the intermediate member 14. Thereby, the intermediate member 14 can be processed with high dimensional accuracy. A position and posture of the intermediate member 14 in the connected state are stabilized with high accuracy by a combination of the highly accurate engaging member 20 and the highly accurate intermediate member 14. Therefore, in the connected state, a lower surface 80 (see FIG. 3) of the intermediate member 14 tends to become perpendicular to the axial direction with high accuracy. The high orientation accuracy of the lower surface 80 tends to cause uniform dispersion of the axial force in the connected state in the circumferential direction of the engaging member 20. The uniform dispersion can improve the fixing strength of the engaging member 20.

As described above, the intermediate member 14 is a separate body from the head body 18, to improve the freedom degree of the processing method of the intermediate member 14. Thereby, a screw part formed in the inner peripheral surface 56 of the intermediate member 14 is processed and formed with good accuracy. The screw part 56 having good accuracy facilitates engagement between the screw part 56 and the screw 10.

As described above, FIG. 4 shows a state where the head 4 is disconnected from the shaft-sleeve assembly 12 (hereinafter, referred to as a disconnected state). In the disconnected state, the screw 10 is not released from the head 4. The release prevention is achieved by the intermediate member 14.

As shown in FIG. 3, in the connected state, the intermediate member 14 is not screw-connected to the screw 10. In the connected state, the non-screw part 64 of the screw 10 is located medially in the intermediate member 14. An outer diameter of the non-screw part 64 is less than an inner diameter d7 (see FIG. 11) of the inner peripheral surface 56 of the intermediate member 14. The inner diameter d7 is measured on the basis of a tip of a screw thread. In the connected state, the intermediate member 14 does not affect screw connection between the screw 10 and the sleeve 8. The intermediate member 14 does not hinder the screw connection between the screw 10 and the sleeve 8.

On the other hand, as shown in FIG. 4, in the connected state, the intermediate member 14 is screw-connected to the screw 10. That is, in the disconnected state, the screw 10 is allowed to be screw-connected to the intermediate member 14.

In a process in which the screw connection between the sleeve 8 and the screw 10 is loosened, the screw part of the intermediate member 14 can be screw-connected to the screw part 62 of the screw 10. In the process in which the screw connection between the sleeve 8 and the screw 10 is loosened, screw connection between the screw part of the intermediate member 14 and the screw part 62 is naturally (automatically) caused. The screw connection between the intermediate member 14 and the screw 10 can be also maintained in a state where the screw 10 is completely removed from the sleeve 8 (see FIG. 4). Therefore, the release of the screw 10 is prevented.

Thus, in the golf club 2, the screw 10 cannot be screw-connected to the intermediate member 14 in the connected state. Furthermore, in the golf club 2, the screw 10 is screw-connected to the intermediate member 14 in a process in which the connected state is shifted to the disconnected state.

As shown in FIG. 4, an outer diameter d1 of the intermediate member 14 is greater than an inner diameter of the flange 25. That is, the intermediate member 14 has an outside dimension in which the intermediate member 14 cannot pass through an inner side of the flange 25. Therefore, the screw 10 screw-connected to the intermediate member 14 is not released.

The outer diameter d1 of the intermediate member 14 is greater than an inner diameter d4 (see FIG. 9) defined by a bottom face of the concave part r1 of the engaging member 20.

An axial directional length between a lower end face of the engaging member 20 and an upper end face of the flange 25 is represented by reference character D in FIG. 4. The length D is greater than a thickness C of the intermediate member 14. Therefore, a clearance exists between the lower end face of the engaging member 20 and the upper end face of the flange 25. An axial directional width K2 of the clearance is a difference (D-C).

In the connected state, the axial force caused by the screw 10 presses the intermediate member 14 against the lower end face of the engaging member 20 (see FIG. 3). On the other hand, in the disconnected state, the intermediate member 14 can abut on the upper end face of the flange 25 due to gravity (see FIG. 4).

The intermediate member 14 is not fixed to the head body 18. The intermediate member 14 is in a non-fixed state. The intermediate member 14 can move in the axial direction between the engaging member 20 and the flange 25.

The intermediate member 14 of the non-fixed state (free) tends to absorb dimension error. The intermediate member 14 in the non-fixed state facilitates engagement between the screws when the connected state is shifted to the disconnected state. The intermediate member 14 in the non-fixed state facilitates screw connection between the screw 10 and the intermediate member 14. In respect of a freedom degree of movement of the intermediate member 14, the difference (D−C) is preferably equal to or greater than 0.2 mm, more preferably equal to or greater than 0.3 mm, and still more preferably 0.5 mm In respect of shortening the hosel hole 22 to reduce a weight of a hosel part, the difference (D−C) is preferably equal to or less than 1.0 mm and more preferably equal to or less than 0.8 mm.

When the intermediate member 14 can move in the radial direction, the absorbability of the dimension error is improved, and thereby the screws tend to be engaged. In this respect, a space may exist, the space can allow the intermediate member 14 to move in the radial direction. That is, in respect of the intermediate member 14 capable of moving in the radial direction, the outer diameter d1 of the intermediate member 14 may be less than an inner diameter d5 (see FIG. 4) of the hosel hole 22 in a position where the intermediate member 14 can exist. In respect of improving the freedom degree of movement of the intermediate member 14, a difference (d5−d1) is preferably equal to or greater than 0.1 mm, more preferably equal to or greater than 0.2 mm, and still more preferably equal to or greater than 0.3 mm. When the difference (d5−d1) is excessive, the intermediate member 14 moves excessively, which indeed may deteriorate the engagement between the screws. In this respect, the difference (d5−d1) is preferably equal to or less than 1.5 mm and more preferably equal to or less than 1.0 mm In FIGS. 3 and 4, the inner diameter d5 and the outer diameter d1 are drawn so that the inner diameter d5 is identical to the outer diameter d1.

The axial force does not act on the flange 25 in the connected state. The flange 25 functions as a projecting part for preventing release. A shape of the projecting part for preventing release is not restricted. The projecting part for preventing release is disposed on a lower side (a sole side) of the intermediate member 14.

An axial directional length of the screw part 48 formed in the engaging member 20 is represented by reference character A in FIG. 9. In respect of a positioning effect of the engaging member 20 and fixing strength of the engaging member 20, the length A is preferably equal to or greater than 1.5 mm, more preferably equal to or greater than 2 mm, and still more preferably equal to or greater than 3 mm In respect of suppressing cost of a step for processing the screw part 48, the length A is preferably equal to or less than 5 mm, more preferably equal to or less than 4.5 mm, and still more preferably equal to or less than 4 mm.

An axial directional length of the engaging member 20 is represented by reference character B in FIG. 9. In respect of widening a contact area of the engaging member 20 and the sleeve 8 to improve a rotation preventing effect, the length B is preferably equal to or greater than 5 mm, more preferably equal to or greater than 6 mm, and still more preferably equal to or greater than 7 mm. In respect of reducing a weight of the engaging member 20 to improve a design freedom degree of a position of a center of gravity of the head 4, the length B is preferably equal to or less than 12 mm, more preferably equal to or less than 11 mm, and still more preferably equal to or less than 10 mm.

A thickness of the intermediate member 14 is represented by reference character C in FIG. 11. In respect of suppressing deformation caused by the axial force, the thickness C is preferably equal to or greater than 0.8 mm, more preferably equal to or greater than 1 mm, and still more preferably equal to or greater than 1.2 mm In respect of reducing a weight of the intermediate member 14 to improve a design freedom degree of a position of a center of gravity of the head 4, the thickness C is preferably equal to or less than 1.8 mm, more preferably equal to or less than 1.6 mm, and still more preferably equal to or less than 1.4 mm.

A maximum diameter of a screw head part 58 is represented by reference character d6 in FIG. 12. In respect of ensuring transmission of the axial force to the engaging member 20, the maximum diameter d6 is preferably less than the inner diameter of the flange 25. In other words, it is preferable that the screw 10 can pass through the inner side of the flange 25.

In respect of preventing deformation of the intermediate member 14, a difference (d4−d2) between the inner diameter d4 (see FIG. 9) of the engaging member 20 and the outer diameter d2 (see FIG. 10) of the washer 16 is preferably equal to or less than 0.5 mm, more preferably equal to or less than 0.3 mm, and still more preferably equal to or less than 0.1 mm. The difference (d4−d2) may be 0 mm or a minus value.

A material of the head body is not restricted. Preferable examples of the material include a metal, carbon fiber reinforced plastic (CFRP) and a combination thereof. More preferable examples include the metal. Examples of the metal include a titanium alloy, stainless steel, an aluminium alloy, a magnesium alloy, and a combination thereof. A manufacturing method of each of the members constituting the head body is not restricted. Examples of the manufacturing method include forging, casting, pressing, NC processing, and a combination thereof.

A material of the shaft is not restricted. Examples of the material of the shaft include carbon fiber reinforced plastic (CFRP) and a metal. A so-called carbon shaft and steel shaft can be suitably used. A structure of the shaft is not restricted.

A material of the sleeve is not restricted. Preferable examples of the material include a titanium alloy, stainless steel, an aluminium alloy, a magnesium alloy, and a resin. In respect of strength and lightweight, for example, the aluminium alloy and the titanium alloy are more suitable. It is preferable that the resin has excellent mechanical strength. For example, the resin is preferably a resin referred to as an engineering plastic or a super-engineering plastic.

A material of the engaging member is not restricted. Preferable examples of the material include a titanium alloy, stainless steel, an aluminium alloy, a magnesium alloy, and a resin. It is preferable that the resin has excellent mechanical strength. For example, the resin is preferably a resin referred to as an engineering plastic or a super-engineering plastic.

A material of the screw is not restricted. Preferable examples of the material include a titanium alloy, stainless steel, an aluminium alloy, a magnesium alloy, an engineering plastic, and a super-engineering plastic.

EXAMPLES

Hereinafter, the effects of the present invention will be clarified by examples. However, the present invention should not be interpreted in a limited way based on the description of the examples.

Example 1

The same golf club as the golf club 2 described above was produced. First, a first member (face member) obtained by pressing a rolling material and a second member obtained by casting were respectively produced. An opening existed in a face part of the second member. Next, a screw part (female screw) was formed in a hosel hole of the second member. The screw was formed by NC processing. Therefore, the screw part was formed with high accuracy.

Separately, a shaft (a carbon shaft), a sleeve, an intermediate member, a washer, a screw, and an engaging member were produced. A material of the sleeve was an aluminum alloy, and a weight of the sleeve was 5 g. A material of the engaging member was 6-4 titanium (Ti-6Al-4V), and a weight of the engaging member was 1.5 g. A material of the screw was 6-4 titanium (Ti-6Al-4V), and a weight of the screw was 1.0 g.

The intermediate member was inserted into the hosel hole of the second member. Then, the engaging member was inserted into the hosel hole of the second member, and a male screw of the engaging member was screw-connected to a female screw of the hosel hole. Next, a hosel external surface is irradiated with laser, to weld the engaging member to the hosel hole. Laser irradiation was performed by utilizing the opening. Next, the first member (face member) was welded to the opening of the second member, to obtain a head. A weight of the head was 180 g. Each of materials of the first member and the second member was 6-4 titanium (Ti-6Al-4V).

The sleeve was bonded to the shaft, to obtain a shaft-sleeve assembly. The shaft-sleeve assembly was inserted into the hosel hole of the head body. The screw was inserted into a through hole of a sole through the washer, to screw-connect the screw to the sleeve of the shaft-sleeve assembly. The screw connection was completed, to obtain a golf club.

In the example 1, a length A (see FIG. 9) of the screw part was set to 3 mm. An axial directional length of the female screw in the hosel hole was also set to 3 mm A length B (see FIG. 9) of the engaging member was set to 7.5 mm.

Example 2

A golf club of example 2 was obtained in the same manner as in the example 1 except that a length A (see FIG. 9) of a screw part was set to 7.5 mm and an axial directional length of a female screw in a hosel hole was also set to 7.5 mm.

Example 3

A golf club of example 3 was obtained in the same manner as in the example 1 except that an intermediate member was fixed to a hosel hole by welding.

Example 4

Figure 15:
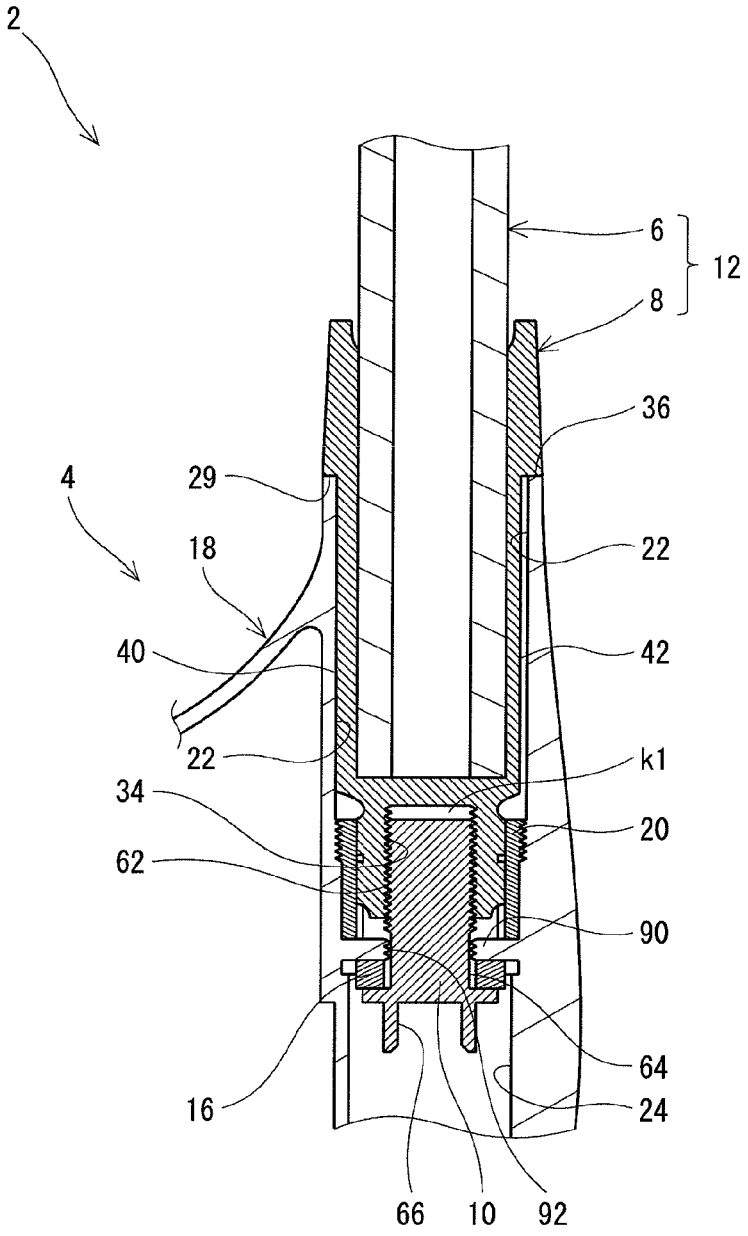
FIG. 15 is a cross sectional view of example 4.

FIG. 15 is a cross sectional view of example 4. The example 4 does not have an intermediate member. As shown in FIG. 15, a head body 18 of the example 4 has a flange 90 in place of the intermediate member. A screw part 92 is formed in an inner peripheral surface of the flange 90. The screw part 92 is a female screw. A specification of the screw part 92 is the same as that of the screw part of the inner peripheral surface 56 of the intermediate member 14. A golf club of example 4 was obtained in the same manner as in the example 1 except for that.

Comparative Example 1

A screw part was not formed in an engaging member, and the engaging member was fixed to a head body by only welding. A golf club of comparative example 1 was obtained in the same manner as in the example 4 except for that.

Comparative Example 2

A screw part was not formed in an engaging member, and the engaging member was fixed to a head body by only welding. A golf club of comparative example 2 was obtained in the same manner as in the example 1 except for that.

Specifications and evaluation results of the examples and the comparative examples are shown in the following Table 1. The evaluation methods are as follows.

[Fixing Strength of Engaging Member]

A head from which a shaft-sleeve assembly and a screw were removed was fixed to an exclusive jig. Next, an axial directional upward force was applied to an intermediate member using a metal bar. The force was transmitted to an engaging member via the intermediate member. The term "upward force" means a force toward a hosel end face side. The force was gradually increased, and a force at a moment when the fixation of the engaging member was removed was measured. The force is shown in the following Table 1. The data of Table 1 is an average value of five data, and a value obtained by rounding off hundreds place.

[Endurance]

The golf club was mounted to a swing robot and the swing robot hit a ball at a head speed of 54 (m/s). A commercially available two-piece ball was used as the ball. A fixing state of an engaging member was checked for every 1000 hit balls. The number of the hit balls when the engaging member is removed is shown in the following Table 1.

[Defective Fraction of Release Preventing Mechanism]

An operation was performed, which loosens connection between a screw and a shaft-sleeve assembly and removes the shaft-sleeve assembly. In a process of the operation, a case where a female screw of an intermediate member (or flange) was not smoothly engaged with a screw was determined to be poor. 20 heads were tested to calculate defective fractions of the heads. The defective fractions are shown in the following Table 1.

TABLE 1

Specifications and evaluation results of examples and comparative examples

| Item | Unit | Example 1 | Example 2 | Example 3 | Example 4 | Comparative Example 1 | Comparative Example 2 |
|---|---|---|---|---|---|---|---|
| Length B of engaging member | mm | 7.5 | 7.5 | 7.5 | 7.5 | 7.5 | 7.5 |
| Length A of screw part | mm | 3 | 7.5 | 3 | 3 | — | — |
| State of intermediate member | — | Non-fixing | Non-fixing | Fixing | No intermediate member | No intermediate member | Non-fixing |
| Fixing strength of engaging member | N | 25000 | 33000 | 25000 | 25000 | 7000 | 7000 |
| Endurance (H/S 54 m/s) | Number of times | 22000 | 35000 | 22000 | 22000 | 15000 | 15000 |
| Defective fraction of release preventing mechanism | % | 0.5 | 0.5 | 10 | 20 | 20 | 0.5 |

As shown in Table 1, fixing strength and endurance of an engaging member when the engaging member is fixed by only welding are lower than those when the engaging member is fixed using welding and screwing.

In the comparative example 1, the flange was provided in place of the intermediate member. The flange is integrally formed with the head body, and cannot move freely. Therefore, the odds are high that the flange cannot be smoothly screw-connected to the screw 10 as compared with the non-fixed intermediate member. It is hard to thread the flange located in the head body. Thereby, the odds are high that a defect is caused in the screw part of the inner peripheral surface of the flange. From these reasons, "the defective fraction of the release preventing mechanism" of the comparative example 1 is higher than those of the examples.

The intermediate member is fixed in the example 3. The odds are high that the fixed intermediate member cannot be smoothly screw-connected to the screw 10 as compared with the non-fixed intermediate member. When the intermediate member is welded, the intermediate member may be deformed by heat. The screw part of the intermediate member may be deformed by the heat deformation. From these reasons, "the defective fraction of the release preventing mechanism" of the example 3 is higher than those of the examples 1 and 2.

As shown in Table 1, the advantages of the present invention are apparent.

The present invention described above can be applied to all golf clubs.

The description hereinabove is merely for an illustrative example, and various modifications can be made in the scope not to depart from the principles of the present invention.

What is claimed is:

1. A golf club comprising: a head; a shaft; a sleeve; and a screw, wherein the sleeve is fixed to a tip part of the shaft;

the head has a head body and an engaging member;

the engaging member is fixed to the head body;

rotation of the sleeve to the head is regulated based on engagement between the sleeve and the engaging member;

withdrawal of the sleeve from the head is regulated based on connection between the sleeve and the screw;

a connected state, where the screw is connected to the sleeve, and a disconnected state, where the screw is removed from the sleeve, can be mutually shifted;

the head body has a screw part for connecting the engaging member to the head body;

the engaging member has a screw part, the engaging member being integrally formed as one piece including the screw part;

the screw part of the head body is connected to the screw part of the engaging member so as to make a screw connection; and an external surface of the sleeve forms a first rotation-preventing part, and an inner surface of the engaging member forms a second rotation-preventing part, the first rotation-preventing part being engaged with the second rotation-preventing part, wherein a welding is used to fix the engaging member to the head body in addition to the screw connection, wherein the golf club further comprises an intermediate member, the intermediate member having a screw part which can be connected to the screw; and the screw is allowed to be screw-connected to the intermediate member in the disconnected state, and wherein the intermediate member receives an axial force from the screw in the connected state.

2. The golf club according to claim 1, wherein the engaging member receives an axial force of the screw in the connected state.

3. The golf club according to claim 1, wherein the screw cannot be screw-connected to the intermediate member in the connected state; and the screw is screw-connected to the intermediate member in a process in which the connected state is shifted to the disconnected state.

4. The golf club according to claim 1, wherein the intermediate member is in a non-fixed state: and release of the intermediate member caused by gravity is prevented.

5. The golf club according to claim 4, wherein a space exists, the space can allow the intermediate member to move in an axial direction.

6. The golf club according to claim 1, wherein the sleeve includes a recessed surface extending in an axial direction, said recessed surface is not brought into direct contact with an inner surface of the head body when the sleeve is inserted into the head body, the inner surface of the head body defining a hosel hole for receiving the sleeve.

* * * * *